US005718289A

United States Patent [19]

Schnatzmeyer et al.

[11] Patent Number: 5,718,289

[45] Date of Patent: Feb. 17, 1998

[54] APPARATUS AND METHOD FOR USE IN INJECTING FLUIDS IN A WELL

[75] Inventors: Mark A. Schnatzmeyer, Lewisville; Charles R. Williams, Carrollton, both of Tex.

[73] Assignee: Halliburton Energy Services, Inc., Dallas, Tex.

[21] Appl. No.: 611,358

[22] Filed: Mar. 5, 1996

[51] Int. Cl.[6] ..... E21B 43/25

[52] U.S. Cl. ..... 166/305.1; 166/90.1; 166/117.6

[58] Field of Search ..... 166/305.1, 306, 166/307, 308, 310, 312, 373, 117.6, 90.1

[56] References Cited

U.S. PATENT DOCUMENTS

| | | | |
|---|---|---|---|
| 3,051,243 | 8/1962 | Grimmer et al. | 166/224 |
| 3,071,193 | 1/1963 | Raulins | 166/226 |
| 3,395,758 | 8/1968 | Kelly et al. | 166/100 |
| 3,414,060 | 12/1968 | Zak | 166/214 |
| 4,355,686 | 10/1982 | Arendt et al. | 166/313 |
| 4,390,061 | 6/1983 | Short | 166/53 |
| 4,399,871 | 8/1983 | Adkins et al. | 166/325 |
| 4,440,218 | 4/1984 | Farley | 166/51 |
| 4,662,452 | 5/1987 | Ross et al. | 166/334 |
| 4,685,519 | 8/1987 | Stowe et al. | 166/278 |
| 4,921,044 | 5/1990 | Cooksey | 166/116 |
| 4,934,460 | 6/1990 | Coronado | 166/386 |
| 5,085,277 | 2/1992 | Hopper | 166/341 |
| 5,156,220 | 10/1992 | Forehand et al. | 166/386 |
| 5,217,067 | 6/1993 | Landry et al. | 166/68 |
| 5,309,993 | 5/1994 | Coon et al. | 166/115 |
| 5,316,084 | 5/1994 | Murray et al. | 166/332 |

*Primary Examiner*—Frank Tsay

*Attorney, Agent, or Firm*—William M. Imwalle; Paul I. Herman; John Booth

[57] ABSTRACT

A removable injection valve insert assembly is disclosed for deploying in production tubing of a well casing. The production tubing includes a landing nipple with an inlet and a sliding side-door which covers and seals the inlet when in a closed position and uncovers the inlet when in an open position. The insert assembly controls the flow of flushing fluid that is injected into the inlet from an annular source between the casing and the production tubing. The valve directs the controlled flushing fluid to an injection line, which in turn injects the flushing fluid into the production stream of the well. Preferably, the injected flushing fluid is injected below the casing perforations. The insert assembly comprises a body having upper and lower ends, a first passage formed in the body for receiving the fluid from the inlet and a second passage in communication with the first passage for housing a flow control valve. The body also includes a by-pass passageway which allows production flow across the insert. The second passage extends to the lower end of the body and receives the injection line. The injection line extends down the production tubing to the casing perforations to inject flushing fluid into the production flow to reduce concentrations of salt and other elements in the production flow and to dislodge deposits that may build up in the perforations.

31 Claims, 4 Drawing Sheets

APPARATUS AND METHOD FOR USE IN INJECTING FLUIDS IN A WELL

TECHNICAL FIELD OF THE INVENTION

The present invention relates to an apparatus and method of injecting fluids in a well and, more specifically, relates to an apparatus and method for deploying a flow control device downhole in a well.

BACKGROUND OF THE INVENTION

Oil and gas production from a hydrocarbon-bearing geological formation can in some fields yield high levels of salt and other elements which can seriously hamper the performance of the well. The well casing extends down into the formation and includes a plurality of perforations that extend laterally into the formation to permit the flow of hydrocarbons into the well. Production tubing, which extends down the casing, and packers are then used to conduct the hydrocarbon out of the well. Salt and other elements from the reservoir tend to deposit in the production tubing and, more significantly, in the perforations that extend from the casing into the formation. Over time, deposits can build up in the wall of these perforations and along the flow path and significantly reduce the diameter of the perforations and, in turn, reduce the production flow from the well. Also, over the life of a well, its production rate and the amounts of undesirable elements present in the hydrocarbon production varies.

Deposits of salt and other water-soluble elements can be removed and/or prevented by flushing the well with water. However, conventional methods and apparatus for flushing wells cannot be installed during well production without pulling the tubing. Therefore, there is a need for a device and method which can be easily installed for use in injecting flushing water into the well to reduce the build up of these deposits. Also, there is a need for a device which can provide flexibility to accommodate changes in downhole well conditions.

SUMMARY OF THE INVENTION

An injection valve insert assembly for injecting flushing water into a well casing through production tubing is disclosed. The production tubing is conventional design and extends down the interior of the casing and is positioned in place and sealed off against the casing by conventional packers.

The production tubing is provided with a landing nipple assembly. The landing nipple includes an inlet or port connecting with casing-tubing annulus. Also a sliding side-door assembly is provided that covers and seals the inlet when in a closed position and uncovers the inlet when in an open position, thus acting as a shut-off. A source of flushing water is supplied through the annulus and inlet and into the landing nipple.

The valve insert assembly is mounted in the landing nipple in the production tubing to control the flow of the flushing water through the inlet. Flushing water tubing (or "tailpipe") extends from the valve insert to a position at or below the perforations. The flushing water flows through the tubing and continuously dilutes the production flow and, therefore, reduces deposits of salt and other elements in the perforations and elsewhere in the production string. Furthermore, by directing a pressurized flow of flushing water below the perforations, the entire production flow will be diluted. Dilution of the production flow reduces the precipitation of the salt and other elements and, consequently, reduces the deposits in the perforations and the production tubing without restriction of production.

The insert assembly comprises a valve housing and upper and lower pipe members. The housing includes upper and lower ends, an inlet passage in fluid communication with the inlet of the landing nipple, and a valve receptacle for releasably housing a valve. The valve receptacle includes a lower portion that extends to the lower end of the housing and is adapted to receive the injection tube.

The housing further includes at least one by-pass passage that extends from the upper end to the lower end of the housing to allow production to continue while the insert assembly is in the landing nipple. If design parameters permit, the by-pass passage is of a size to permit tooling to pass down the production tubing with the insert assembly in place. In the preferred embodiment, the valve housing is offset to the side of the tubing to maximize the by-pass passageway. An alternate embodiment includes a centrally positioned valve housing with a plurality of segment-shaped by-pass passages.

The upper and lower pipe members provide a landing and retrieving structure for the insert assembly. They also provide surfaces for sealing the insert assembly against the inner surface of the production tubing. Preferably, the upper and lower pipe members include packing or seals to seal the insert assembly in the landing nipple.

A flow regulator valve or other flow control device having an inlet and an outlet is housed in the assembly's housing receptacle. The valve inlet is in communication with the inlet passage of the housing so that flushing water can pass through the valve from the inlet passage. The valve outlet is directed to the lower portion of the receptacle and is in fluid communication with the injection tubing, so that the flushing water can be discharged into the injection pipe through the valve outlet.

The valve is a conventional pressure compensated flow control valve. Fluid flows into the valve through a strainer shell and strainer core and passes through the orifice. When the fluid passes through the orifice, the pressure in the fluid pushes the piston against the spring. The flow rate through the valve is a function of the orifice size and the spring rate.

In a preferred embodiment, the valve further comprises a check valve to prevent reverse flow of fluids through the flow control valve.

To land the insert assembly in the landing nipple, the insert assembly is designed to engage the sliding side-door in the landing nipple. As the insert assembly runs down the production tubing, the insert connects with the side-door and slides the side-door down the nipple from its initial closed position until the side-door abuts a lower stop of the landing nipple; thus landing the insert assembly in the nipple and moving the side-door to the open position. Once the side-door is open, the flushing water is able to flow through the insert of the landing nipple, into the inlet passage, and then into the valve through the valve inlet. The flushing water flows through and is controlled by the valve and exits the valve through the outlet. The side-door will be closed when the insert assembly is removed, thereby blocking communication between tubing and casing.

The injection tubing or tailpipe preferably comprises coil tubing (or the like, such as a jointed string) connected at one end to the lower end of the insert assembly. The other end extends to the desired injection point, typically at or below the perforations in the well casing. As the tailpipe is in fluid communication with the outlet of the valve, the tailpipe directs and injects the flushing water into the desired region, such as at or below the casing perforations. In a preferred embodiment, the injection line is integral with the lower portion of the receptacle passage. It can appreciated that when the insert assembly is landed in the landing nipple and the side-door is moved to open position, the valve receives flushing water from the inlet of the nipple and discharges the flushing water into injection line, which in turn directs and injects the flushing fluid below the well casing perforations.

In one preferred embodiment of the invention, the insert assembly is modular. The modular insert assembly is similar to previously described insert assembly except that the housing receptacle extends to the uphole side of the housing and forms a landing receptacle for a removable valve. The landing receptacle can include an annular recess or projection onto which the valve releasably latches when it is lowered into the receptacle. In order to land and retrieve the valve independently from the modular insert assembly, the valve is provided with a landing mechanism and a retrieval mechanism. The landing mechanism preferably comprises at least one conventional latch that engages the annular recess. The retrieval mechanism is a conventional fishneck structure that is secured to the top end of the valve. The modular assembly allows the valve to be retrieved from the production tubing for service, replacement, or adjustment without removing the insert assembly.

The various embodiments and methods of the invention reflect several competing interests. First, a removable and retrievable device is desired to accommodate logging tools that need to be run down the well and service work that may be required on the insert assembly. But, at the same time the preferred location of the assembly is downhole in the well to minimize the length of the injection tubing—the greater the length of the tubing, the greater the risk that the tubing may break. Second, it is desired to minimize the tools needed for landing the device and, therefore, the preferred embodiment of the insert assembly is an in-line device.

The modular embodiment of insert assembly permits the valve to be independently retrieved from the well. The valve may need service or repair or may need adjustment to accommodate the reservoir fluctuations. One of the objects of the invention is to provide a constant flow rate of flushing water to the production flow regardless of the reservoir pressure. Flow regulator valves are designed to produce the same flow rate, but only for a given range of pressure. Therefore, if the reservoir characteristics change sufficiently, the pressure on the valve may fall out of the valve's range of operation. Consequently, a valve substitution may be required.

BRIEF DESCRIPTION OF THE DRAWINGS

The accompanying drawing is incorporated into and forms a part of the specification to illustrate examples of the present invention. This drawing together with the description serves to explain the principles of the inventions. The drawings are only included for purposes of illustrating preferred and alternative examples of how the inventions can be made and used and are not to be construed as limiting the inventions to only the illustrated and described examples. Various advantages and features of the present inventions will be apparent from a consideration of the drawings in which.

Other objects and advantages of the invention will become apparent upon reading the following detailed description and upon reference to the drawings, in which like reference characters are used throughout the drawings to designate like parts.

DESCRIPTION OF PREFERRED EMBODIMENTS

Figure 1:
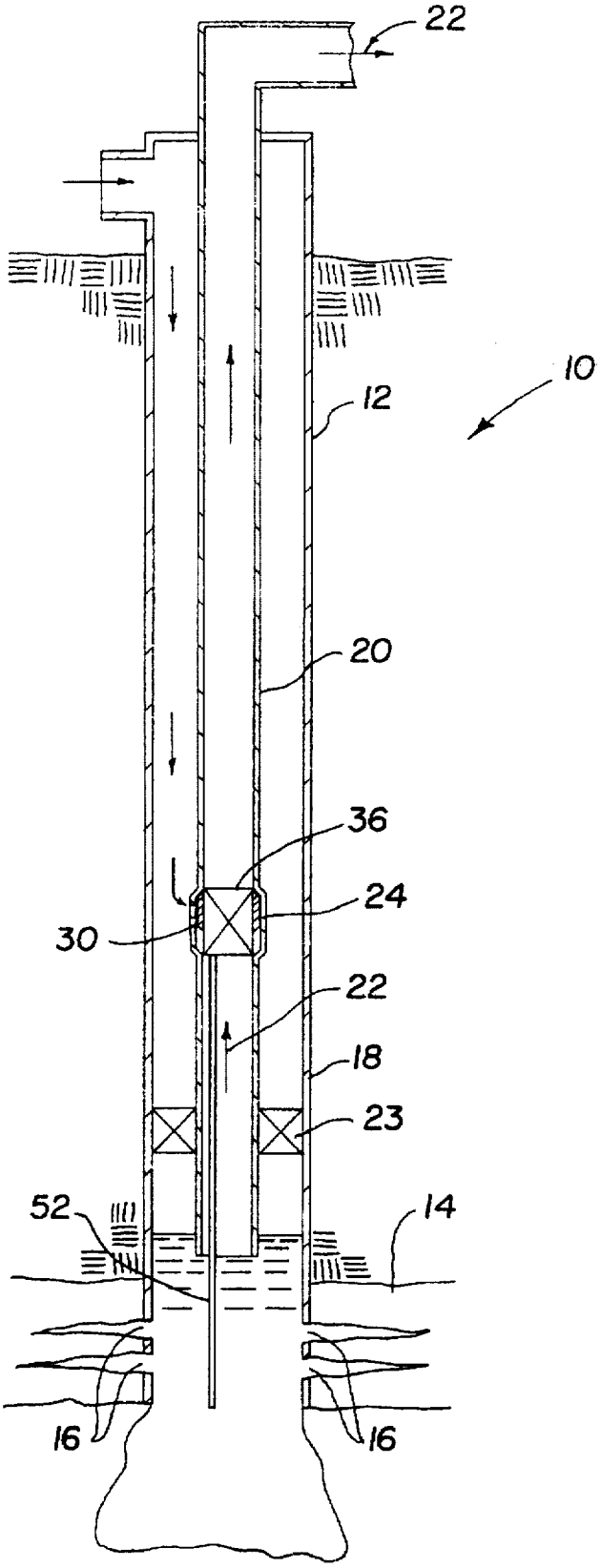
FIG. 1 illustrates a schematic cross-section of a conventional hydrocarbon well configuration with the present invention shown in position downhole in the production tubing.

The present inventions will be described by referring to drawings showing and describing examples of how the inventions can be made and used. In these drawings the same reference characters are used throughout the several views to indicate like or corresponding parts. In these figures and the accompanying description arrow "C" is used to indicate the upward or uphole direction. The reverse of arrow "C" refers to the downward or downhole direction. The upward and downward directions used herein are for reference purposes only, and it is appreciated that not all wells extend vertically, and that the present inventions have utility in nonvertical well configurations.

Referring to FIG. 1, the numeral 10 generally designates a well assembly. Well assembly 10 comprises a casing 12 that is drilled and extends into a hydrocarbon-bearing geological formation 14. Once the casing 12 is drilled and set into place in the formation, perforations 16 are made in the casing wall 18 at a desired elevation in the reservoir to maximize the flow of the reservoir liquids into the casing 12.

Production tubing 20 runs down the casing 12 to provide a conduit for the reservoir fluids 22 to flow to the surface. Tubing 20 is centralized and restrained in casing 12 by conventional packers 23 (only one is shown). Flushing water is pumped into the tubing-casing annulus down to packer 23.

Figure 2:
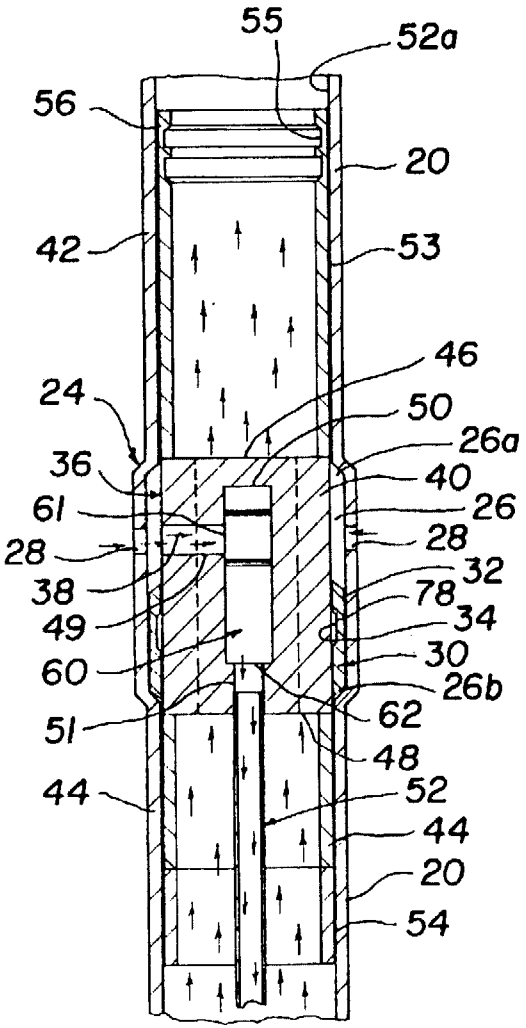
FIG. 2 illustrates a partial cross-section of the valve insert assembly in a landing nipple section of the production tubing.

As best shown in FIGS. 1 and 2, production tubing 20 is provided with a landing nipple 24. Landing nipple 24 comprises an enlarged portion 26 having larger outer and inner diameters than the production tubing 20, upper and lower transition walls **26*a* and 26*b*, and radial ports on inlets 28. The larger inner diameter of the nipple 24 forms an annular space 26 in the production tubing 20 between upper and lower transition walls 26*a* and 26*b*. In this annular space 26, a sliding side-door 30 is provided which slides from an upper closed position to a lower open position. In the closed position the door abuts the upper transition wall 26*a* and covers and seals the inlets 28. In the lower open position (depicted in FIG. 2), the door abuts the lower transition wall 26*b* and the inlets 28** are uncovered.

Sliding side-door 30 comprises an annular member 32 having an annular recess 34 formed on the surface facing inwardly. The recess 34 provides a landing mechanism for the valve insert assembly. As sliding side-door 30 is of conventional design further details are not provided, but reference is made to several U.S. Patents that disclose sliding side-doors and are incorporated by reference. See U.S. Pat. Nos. 5,479,989; 5,381,862; 5,012,871; 5,183,114; and 5,090,481.

A first embodiment of the removable injection valve insert assembly 36 for deploying in production tubing 20 is illustrated in FIG. 2. An injection valve insert assembly 36 is provided in the production tubing 20, as described previously, to inject a controlled flow of flushing water 38 from the annulus and into the production flow 22 adjacent perforations 16. The injected flushing water 38 dilutes the concentration of salt and other elements in the production flow 22. Additionally, by directing a pressurized flow of flushing water 38 below perforations 16, turbulence caused by the introduction of the pressurized flushing water 38 will also tend to dislodge deposits that still may collect near the perforations 16. The flushing water 38 is supplied to the valve insert assembly 36 through inlet 28 via tubing 52 that runs down the production tubing 20.

The insert assembly 36 comprises a housing 40 and upper and lower pipe members 42 and 44. Housing 40 includes upper and lower ends 46 and 48. Inlet passages 49 in housing 40 communicate with the inlets 28 of the landing nipple 24. A receptacle 50 communicates with inlet passages 49. Receptacle 50 includes a lower portion 51 that extends to the lower end 48 of housing 40 and is connected to an injection tubing 52.

Upper and lower pipe members 42 and 44 provide a retrieval structure and provide surfaces for sealing the insert assembly 36 against the inner surface 52 of production tubing 20. As shown in FIG. 2, the retrieval structure comprises a fishneck 55 that is attached to the upper pipe end portion 56. Also in this section, but not shown in the drawing, will be a conventional locator and latch assembly. Fishneck locator and latch designs are conventional elements of downhole assemblies that are well known in the industry and typically perform the functions indicated by their nomenclature.

Upper pipe member 42 further includes an annular seal 53 on its outer surface which seals the insert assembly 36 against the inner surface 52 of tubing 20. Similarly, lower pipe member 44 includes an annular seal 54 to seal the lower end of the insert assembly to the inner surface 52 of tubing 20. Seals 53 and 54 are of conventional design and are designed to seal when the insert assembly 36 is landed in landing nipple 24 of production tubing 20.

In order to provide an in-line insert assembly 36 that does not significantly hamper the production of the well, housing 40 is provided with at least one by-pass passage 58 that extends from upper end 46 of housing 40 to lower end 48 of housing 40. The by-pass passage 58 is illustrated as a kidney shaped passage, but it can be appreciated that the passage can assume other shapes and configurations. If the design parameters of a specific embodiment allow the by-pass passage 58 to be adequately sized, then service or logging tools may be run by the insert assembly 36, without having to remove the insert assembly 36.

A flow regulator valve 60 (or other flow control device, as needed) is provided in housing receptacle 50 and includes an inlet 61 and an outlet 62. Inlet 61 is aligned with inlet passage 49 so that it communicates with the annulus 26 formed by the landing nipple 24 and, consequently, is in communication with inlets 28. When insert assembly 36 is landed in landing nipple and moved downhole, sliding side-door 30 moves to the open position and open inlets 28 allow flushing water 38 to flow into annulus 26 of landing nipple 24. As inlet passage 50 and valve inlet 61 are in fluid communication with annulus 26, the flushing water flows into flow control device 60. The flow exiting from flow control device 60 is then discharged from outlet 62 into the lower portion of receptacle 50.

Figure 7:
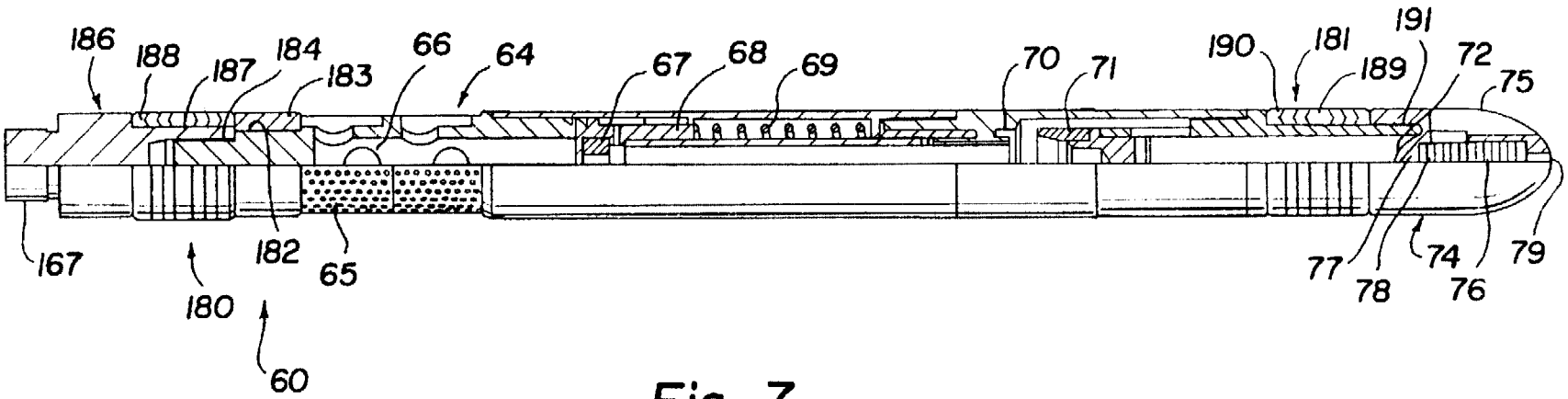
FIG. 7 illustrates a partial cross-section of the a conventional flow regulator valve with a removable check valve mounted on the outlet of the flow regulator valve.

In the embodiment illustrated in FIG. 2, flow control device 60 is integral with the valve housing 40, but includes the internal parts of a comparable discrete device which would perform the same function such as illustrated in FIG. 7.

Referring to FIG. 7, the valve 60 includes an inlet assembly 64 comprising a strainer seal 65 and a strainer core 66 to filter debris from incoming fluids. Pressurized flushing water 38 flows through strainer seal 65 and core 66 to orifice 67. When the flushing water 38 passes through orifice 67, the pressure differential across orifice 67 forces piston 68 to compress spring 69. The spring 69 compresses and permits the water to pass into stem 70 and, subsequently, past seat 71 and out through the bottom cap 72. The flow rate of the valve 60 is a function of the size of the orifice 67 and the size of the spring 69. This feature of valve 60 is important because the pressure on the valve can vary greatly—the pressure on the valve is function of the depth of the valve in the well, the characteristics of the formation, and the pressure of the flushing water. Therefore, in the preferred embodiment, the valve comprises a flow regulator valve where the pressure on the valve can vary, within a fairly wide specified range, without varying the flow rate of the valve output.

Valve 60 can include a check valve 74 in series with valve 60 to prevent reverse flow of fluids through valve 60. Check valve 74 is also conventional and comprises a valve body 75 with a bore 76 extending therethrough. A plug member 77 mounted on the end of a spring 78 is captured in the bore of the valve. Check valve 74 is preferably threaded onto a threaded end of valve 60, with plug member 77 aligned with outlet 72 of valve 60. As would be understood by those skilled in the art, plug member 77 permits unrestricted flow out of outlet 72, as the spring 78 has a low spring constant, but prevents flow into outlet 72. A simplified description has been provided of the check valve as the operation and structure of check valves are well known it the art.

As shown in FIG. 2, to land the insert assembly 36 in the landing nipple 24, insert assembly includes releasable latches 78 extending from housing 40 that engage sliding side-door 30 in landing nipple 24. Latches 78 are biased against housing 40 as insert assembly 36 is run down production tubing 20, but once housing 40 extends into landing nipple 24, the latches engage recess 34 of side-door 30 and latch onto the door. As the insert assembly 36 is lowered further, sliding side-door 30 slides from the closed position to the open position (shown), thus uncovering inlets 28 of landing nipple 24. Latches 78 are conventional and may comprise many different configurations, including a two-stage latching device.

When insert assembly 36 is landed in nipple 24, inlet passages 49 of housing 40 are generally aligned with inlets 28 of nipple 24, thus allowing flushing water 38 to flow through insert assembly 36 into valve 60. Valve 60 directs the flow of flushing water 38 at a controlled flow rate to injection piping 52. Injection tubing 52 in turn injects flushing water 38 into the production flow 22 at the desired location in the well, thus diluting the concentrations of salt and other elements at the influx of production flow.

However, injection tubing 52 may be threaded into or otherwise rigidly secured to lower portion 51. It should be understood that the injection line 52 may be also be run separately from the valve injection assembly, but running the injection pipe independently of insert assembly 36 may pose logistical problems and would, therefore, be less desirable. Furthermore, the injection line would then require its own landing and retrieval mechanisms.

As stated previously, injection pipe 52 extends into the lower end 48 of housing 40 at one end and extends down the production tubing 20 to a desired injection location, such as below perforations 16 at the other end to inject the flushing water into the production flow and thereby reduce concentrations of salt and other elements in the production flow. Moreover, the injection of pressurized water adjacent the perforations will tend to agitate the flow through the perforations so that any deposits that collect near the perforations will be dislodged.

Figure 4:
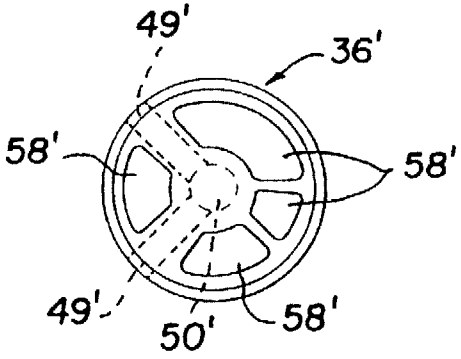
FIG. 4 illustrates a top plan view of a second embodiment of the insert assembly having a plurality of segment shaped by-pass passages.
Figure 3:
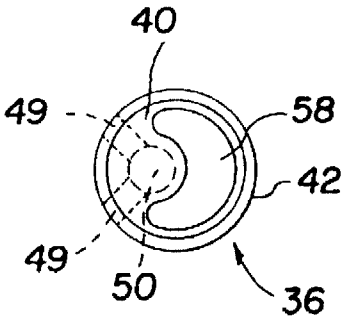
FIG. 3 illustrates a top plan view of a first embodiment of the insert assembly having a single by-pass passage.

A second embodiment of the insert assembly is illustrated in FIG. 4. Housing 40' comprises a centrally positioned receptacle 50' and a plurality of segment-shaped by-pass passages 58'. It should be understood that with these smaller by-pass passages 58' service or logging tool devices may not be able to pass by the injection insert assembly.

Figure 5:
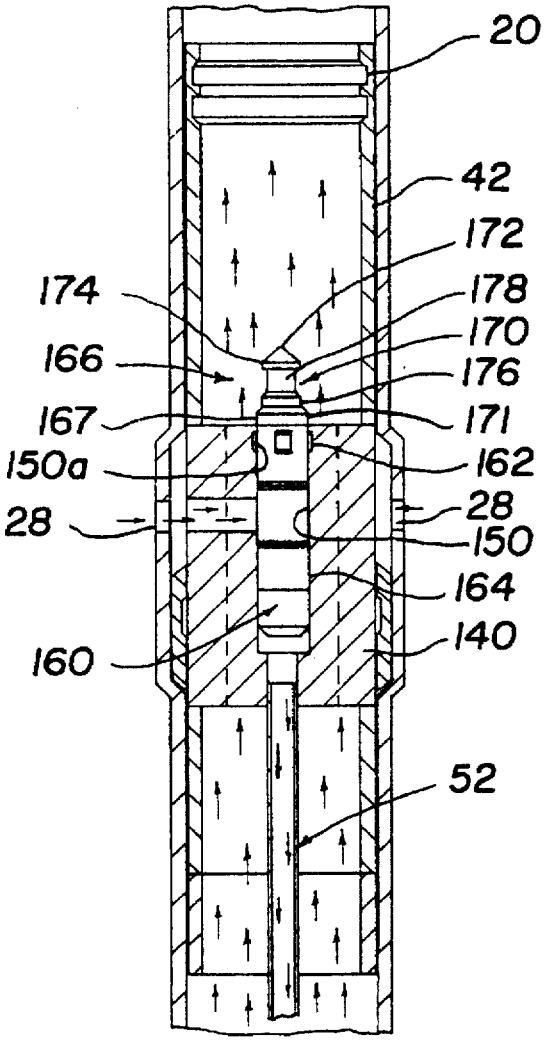
FIG. 5 illustrates a partial cross-section of another embodiment of a modular valve insert assembly, with a removable and retrievable valve.
Figure 6:
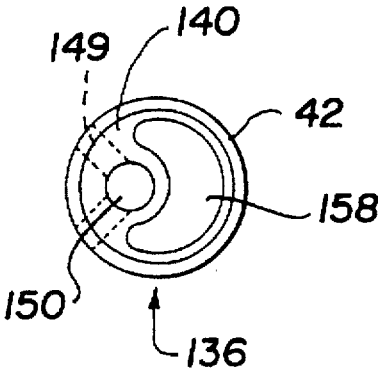
FIG. 6 illustrates a top plan view of the modular valve insert assembly of FIG. 5.

In another preferred embodiment, illustrated in FIG. 5, the injection valve insert assembly comprises a modular assembly 136. Valve receptacle 150 comprises an upwardly open landing receptacle for housing a removable valve assembly 60. In order to land valve 60 in landing receptacle 150, valve 60 includes a landing mechanism 162. Landing mechanism 162 preferably comprises a simple releasable latching device that is biased against the valve body 164 when valve 60 is lowered into the housing 140 and releases and latches onto the receptacle 150 when the latch 162 engages an annular shoulder or recess **150*a* formed in landing receptacle 150**. The latch can be of the type used in side pocket mandrels to removably set valves therein and or known in the industry as "K", "R", or "J" latches.

In order to remotely retrieve valve 60 from valve insert assembly 136, a retrieval structure 166 comprising a fishneck structure is formed on an upper end 167 of valve 60. Fishneck structure 166 comprises a tubular member 170 having a base end 171 connecting the top of valve 60 and a cone shaped distal end 172 for guiding a retrieving tool (not shown) onto the retrieval structure 166. The tubular member 170 includes first and second spaced collars, with the first collar 174 positioned below cone shaped end 172 and second collar 176 positioned at base end 171, defining a neck 178 therebetween. A retrieving tool (not shown) having an inverted cone shaped body is lowered down production tubing 20. As the tool meets the retrieval structure 166, the surfaces of the inverted cone and cone shaped end 172 guide the tool down on to tubular member 170 past first collar 174. Once the tool is past first collar 174, a latch (also not shown), which is provided on the tool, latches on neck 178 of the retrieval structure.

As described above, valve 60 is a flow control device, such as the conventional pressure compensated flow control valve which is detailed in FIG. 7. Removable valve 60, however, further includes elongated top and bottom ends 180 and 181. Top end 180 includes a collar portion 182, on which a spacer pipe 183 is provided, and a threaded end 184. An adaptor structure 186 is threaded onto threaded end 184 of valve 60 and includes a collar 187 on which seal assembly 188 is mounted. Seal assembly 188 is provided to seal valve in receptacle 150 when the valve is landed in housing 140. Similarly second seal assembly 189 is mounted on a collar portion 190 of bottom end 181 of valve 60 for sealing the lower end of valve 60 in receptacle 150. Bottom end 181 also includes a threaded stub 191 extending from collar portion 190 for mounting check valve 74 on to valve 60.

The embodiment shown and described above is only exemplary. Many details which are omitted are well known in the art such as descriptions of the inner workings of perforator tubes, remotely actuatable production valves, pinning nipples, and the like. Therefore, many such details are neither shown or described. It is not claimed that all the details, parts, elements, or steps described and shown were invented herein. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of the parts within the principles of the inventions to the full extent indicated by the broad general meaning of the terms used in the attached claims. The restrictive description and drawings of the specific examples do not point out what an infringement of this patent would be, but are to provide at least one explanation how to make and use the inventions. The limits of the inventions and the bounds of the patent protection are measured by and defined by the following claims.

What is claimed is:

1. A removable injection valve insert assembly for deploying in production tubing in a well casing, the well casing having perforations adjacent a hydrocarbon producing zone, the production tubing having an inner wall and a landing nipple including an inlet that is in communication with a source of flushing fluid, the insert assembly comprising:

a control valve positionable in the production tubing, said control valve in communication with the inlet of the landing nipple for controlling the flow of the flushing fluid from the inlet to an injection tubing; and said injection tubing in fluid communication with said control valve for injecting the flushing fluid into a well in the vicinity of the casing perforations.

2. A removable injection valve insert assembly according to claim 1, further comprising a remotely operated valve movable between a closed flow blocking position and an open flow permitting position for controlling the flow of flushing fluid into and through the inlet, said remotely operated valve in fluid communication with said control valve.

3. A removable injection valve insert assembly according to claim 2, further comprising a housing having upper and lower ends, a first passage formed in said housing for receiving the flushing fluid, a second passage formed in said housing for housing said control valve, said second passage in communication with said first passage and extending to said lower end of said housing.

4. A removable injection valve insert assembly according to claim 3, wherein said housing includes at least one by-pass passage formed therein extending from said upper end of said housing to said lower end of said housing, said by-pass passage providing a by-pass for production flow.

5. A removable injection valve insert assembly according to claim 4, wherein said housing further includes means for landing said insert assembly in the landing nipple and for moving the remotely operated valve from the closed flow blocking position to the open flow permitting position.

6. A removable insert assembly according to claim 3, wherein said control valve includes means for releasably latching said control valve in said second passage of said housing.

7. A removable insert assembly according to claim 6, wherein said control valve includes means for remotely retrieving said control valve from said housing.

8. A removable insert assembly according to claim 1, wherein said control valve comprises a flow regulator valve.

9. A removable insert assembly according to claim 1, wherein said control valve comprises an orifice valve.

10. A removable insert assembly according to claim 3, further comprising an upper pipe portion extending from said upper end of said housing and a lower pipe portion extending from said lower end of said housing, said upper and lower pipe portions including means for sealing said upper and lower pipe portions to the inner wall of the production tubing.

11. A removable insert assembly according to claim 10, wherein said upper pipe portion includes means for retrieving said insert assembly from the production tubing.

12. A removable injection valve insert assembly according to claim 2, further comprising a check valve in series with said control valve to prevent reverse flow through said control valve.

13. A removable injection valve insert assembly for deploying in a production tubing in a well casing, the well casing having perforations adjacent a formation, the production tubing having a landing nipple with an inlet, the inlet in communication with a source of flushing fluid, and a remotely operable valve movable between a closed flow blocking position and open flow permitting position for controlling the flow of flushing fluid through the inlet, the insert assembly comprising:

a control valve positionable in the production tubing, for communicating with the remotely operable valve and for discharging the flushing fluid into the well below the casing perforations;

a housing having upper and lower ends, an inlet passage for receiving the fluid from the remotely operable valve, and a valve receptacle releasably housing said control valve, said inlet passage in fluid communication with said valve;

means for releasably latching said insert assembly to the landing nipple of the production tubing and for moving the remotely operable valve to the open flow permitting position; and means for retrieving said insert assembly from the production tubing.

14. An injection valve insert assembly according to claim 13, wherein said insert assembly further includes injection tubing in fluid communication with said control valve, said injection tubing extending from said lower end of said housing for injecting the flushing fluid below the casing perforations.

15. An injection valve insert assembly according to claim 13, wherein said control valve includes means for releasably latching said control valve in said receptacle and for remotely retrieving said control valve from said housing.

16. An injection valve insert assembly according to claim 13, wherein said control valve comprises a flow regulator valve including means to prevent reverse flow through the control valve.

17. An injection valve insert assembly according to claim 16, wherein said means to prevent reverse flow comprises a check valve.

18. An injection valve insert assembly according to claim 13, wherein said means for retrieving said insert assembly from said production tubing comprises an upper pipe member extending from said upper end of said housing, said upper pipe member having a fishneck.

19. A removable injection valve insert assembly according to claim 13, further comprising a check valve in series with said control valve to prevent reverse flow through said control valve.

20. A modular injection valve insert assembly for deploying in production tubing of a well, the production tubing having a landing nipple, the landing nipple including an inlet and a sliding door which covers and seals the inlet when in a closed position and uncovers the inlet when in an open position, the modular injection valve insert assembly comprising:

a housing having upper and lower ends, at least one inlet passage formed therein for receiving a fluid from the inlet of the landing nipple, a landing receptacle formed therein in fluid communication with said inlet passage, and at least one by-pass passage formed in said housing extending from said upper end of said housing to said lower end of said housing, said by-pass passage providing a by-pass for production flow;

a valve having an inlet and an outlet, said valve having means to land and releasably latch said valve in said landing receptacle of said housing such that said inlet of said valve is in fluid communication with said inlet passage;

an injection line extending from said lower end of said housing and in fluid communication with said outlet of said valve;

means for landing and releasably latching said housing in the landing nipple and for sliding the door to the open position; and means for retrieving said modular insert assembly from said production tubing.

21. A modular injection valve insert assembly according to claim 20, further comprising means for retrieving said valve from said housing.

22. A well comprising:

a casing for extending into a hydrocarbon producing zone, said casing including a plurality of perforations for receiving production flow from the hydrocarbon producing zone;

production tubing extending down said casing for directing the production flow of the hydrocarbon producing zone up the casing, said production tubing having an inlet and a remotely operable valve movable between a closed flow blocking position and an open flow permitting position for controlling the flow of flushing fluid through the inlet;

a source of flushing fluid in fluid communication with said inlet;

a control valve positioned in said production tubing, said control valve communicating with said remotely operable valve and having means to move said remotely operable valve between said closed flow blocking position and said open flow permitting position, said control valve for controlling the discharge of said flushing fluid into injection tubing; and injection tubing in fluid communication with said control valve for injecting the flushing fluid below said perforations.

23. A well according to claim 22, wherein said control valve is positioned in-line in said production tubing.

24. A well according to claim 23, wherein said control valve is supported in a housing, said housing comprising: a body having an upper end and a lower end, at least one inlet passage formed in said body in fluid communication with said inlet, a receptacle formed in said body supporting said control valve, said receptacle in fluid communication with said inlet passage, said receptacle in fluid communication with said injection tubing, and at least one by-pass passage formed in said body extending from said upper end of said housing to said lower end of said housing, said by-pass passage providing a by-pass for production flow.

25. A well according to claim 24, wherein said housing includes means for landing said insert assembly in said production tubing adjacent said at least one inlet passage.

26. A method of injecting flushing fluid into the production flow of a well, the well including a casing and production tubing extending down the casing for directing the production flow up the casing, the casing includes perforations extending into a reservoir, the production tubing is mounted in the casing by at least one packer, the method comprising the steps of:

injecting flushing fluid down a well between the well casing and the production tubing;

positioning a flow inlet in the production tubing above the packer;

directing the flushing fluid through the flow inlet into the production tubing;

controlling the flow of the flushing fluid flowing through the flow inlet;

conveying the flow of the controlled flushing fluid down the production tubing; and injecting the controlled flushing fluid into the production flow of the well at a point below the flow inlet.

27. A method of injecting flushing fluid into the production flow of a well according to claim 26, wherein the step of controlling the flow of the flushing fluid comprises the step of:

selectively opening and closing the inlet to permit flushing fluid to flow through the inlet.

28. A method of injecting flushing fluid into the production flow of a well according to claim 27, wherein the step of controlling the flow of the flushing fluid further comprises the step of:

controlling the flow rate of the flushing fluid from the flow inlet.

29. A method of injecting flushing fluid into the production flow of a well according to claim 28, wherein the step of controlling the flow of the flushing fluid further comprises the step of:

preventing back flow through the inlet.

30. A method of injecting flushing fluid into the production flow in production tubing according to claim 26, wherein the steps of controlling the flow of the flushing fluid comprises the steps of:

positioning an injection valve in series with a check valve in the production tubing;

positioning the injection valve and check valve assembly in fluid communication with said inlet, said valve assembly including a discharge port; and extending an injection line from the valve assembly to the casing perforations for injecting the flushing fluid into the production flow in the vicinity of the perforations, said injection line in fluid communication with the discharge port of the valve assembly.

31. A method of deploying a valve insert assembly in a production tubing of a well casing, the method comprising the steps of:

providing a landing nipple in production tubing of a well, the landing nipple including an inlet and a remotely operable valve movable between a closed flow blocking position and an open flow permitting position for controlling the flow of flushing fluid through the inlet;

positioning a valve insert assembly in-line down the production tubing, the valve insert assembly including a flow regulator valve having an inlet and an outlet and means for moving said remotely operable valve from the closed flow blocking position to open flow permitting position;

landing the valve insert assembly in the landing nipple;

moving said remotely operable valve from the closed flow blocking position to open flow permitting position when said insert assembly is landed in said landing nipple;

aligning the inlet of the valve with the inlet of the nipple;

injecting flushing fluid into the casing and into the valve insert assembly through the nipple inlet when the valve insert assembly is landed in the nipple;

directing the flushing fluid from the inlet of the nipple to the inlet of the valve;

directing the flushing fluid through the valve and injecting the flushing fluid into an injection pipe; and positioning the injection pipe at the perforations in the casing to dilute concentrations of salts and other minerals in the production flow.

* * * * *